US006279621B1

(12) United States Patent
Gelsomino

(10) Patent No.: US 6,279,621 B1
(45) Date of Patent: Aug. 28, 2001

(54) PORTABLE HANDS-FREE GAS PUMPING DEVICE AND METHOD THEREFOR

(76) Inventor: J. Terry Gelsomino, 6517 Pioneer Rd., W. Palm Beach, FL (US) 33413

( * ) Notice: Subject to any disclaimer, the term of this patent is extended or adjusted under 35 U.S.C. 154(b) by 0 days.

(21) Appl. No.: 09/649,919

(22) Filed: Aug. 30, 2000

(51) Int. Cl.[7] ..... B65B 1/04; B65B 3/04

(52) U.S. Cl. ..... 141/1; 141/392; 251/90; 74/526

(58) Field of Search ..... 141/1, 392, DIG. 1; 137/15; 251/90, 111; 74/526

(56) References Cited

U.S. PATENT DOCUMENTS 4,175,595 * 11/1979 Noe ..... 141/1
4,334,560 * 6/1982 Lockwood ..... 141/392
6,095,173 * 8/2000 Perry ..... 137/15

* cited by examiner

*Primary Examiner*—Timothy L. Maust
(74) *Attorney, Agent, or Firm*—Weiss & Moy, P.C.; Jeffrey Weiss; Harry M. Weiss

(57) ABSTRACT

A portable hands-free gas pumping device and method therefor, comprising a elongated body which can be inserted between a bottom surface of an activation lever and a bottom portion of a gas pump handle frame in order to maintain the activation lever in an activated position during the fueling process.

14 Claims, 1 Drawing Sheet

PORTABLE HANDS-FREE GAS PUMPING DEVICE AND METHOD THEREFOR

FIELD OF THE INVENTION

This invention relates generally to gas pumping devices and, more specifically, to a hands-free gas pumping device having the characteristics of portability and ease of use.

BACKGROUND OF THE INVENTION

All vehicle owners who have had occasion to use a self-service gas pump are well familiar with the mechanics of filling a gas tank. Where the pump activation lever has to be manually held in position by the vehicle owner, the process of filling the gas tank can be time-consuming and uncomfortable, and can result in the inhalation of harmful vapors. If not for the need to keep his or her hand on the activation lever, a person pumping gas could otherwise engage in more useful activities, such as cleaning the vehicle's windows, going to the bathroom, purchasing something to drink or eat, using a phone, or the like.

Some gas stations equip the gas pump handle with an integral latch or other device which can be used to maintain the activation lever in an activated position without the continued use of a person's hand. However, the constant use of these devices causes many of them to become unreliable. Additionally, many gas stations are not equipped with these devices at all.

A need therefore existed for a portable hands-free gas pumping device which can be carried by the driver from gas station to gas station and used to keep the activation lever in an activated position without the continued use of a person's hand.

SUMMARY OF THE INVENTION

An object of the present invention is to provide a portable hands-free gas pumping device capable of providing the user with the hands-free ability to pump gas into his or her vehicle at various gas stations.

It is a further object of the present invention to provide a method for pumping gas allowing for hands-free operation and portability.

BRIEF DESCRIPTION OF THE PREFERRED EMBODIMENTS

In accordance with one embodiment of the present invention, a portable device for hands-free pumping of gas is disclosed, comprising, in combination: a portable, detached elongated body having a top portion and a bottom portion; wherein the portable, detached elongated body is dimensioned to be interposed between a bottom portion of a gas pump handle frame and a bottom surface of a gas activation lever when the activation lever is in an activated position, so as to maintain the activation lever in the activated position.

In accordance with another embodiment of the present invention, a method for hands-free pumping of gas is disclosed, comprising, in combination, the steps of: providing a portable, detached elongated body having a top portion and a bottom portion; wherein the portable, detached elongated body is dimensioned to be interposed between a bottom portion of a gas pump handle frame and a bottom surface of a gas activation lever when the activation lever is in an activated position, so as to maintain the activation lever in the activated position; activating the activation lever by pulling it in a direction toward the top portion of the gas pump handle frame; and interposing the elongated body between the bottom portion of the gas pump handle frame and the bottom surface of the activation lever so as to maintain the activation lever in an activated position.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 3:
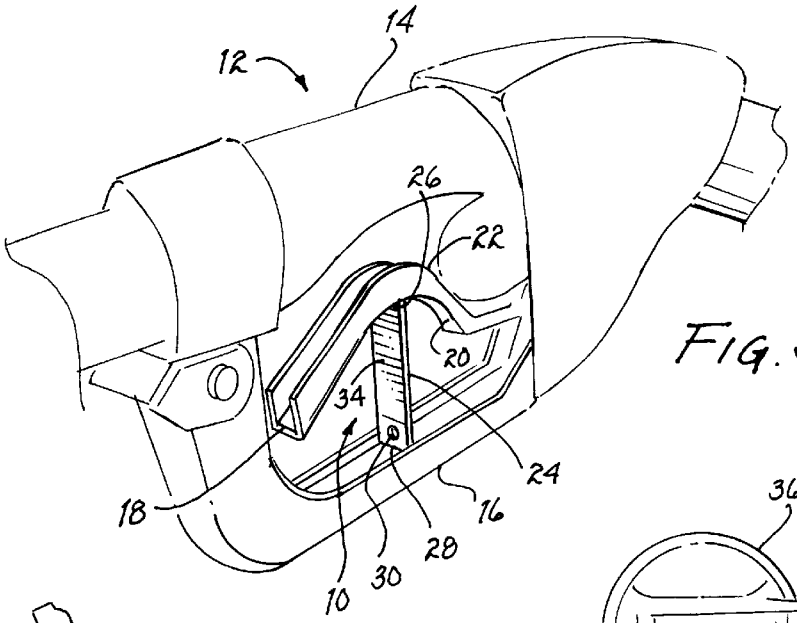
FIG. 3 is a perspective view of the device of FIG. 1 in position between a gas pump activation lever and a bottom portion of a gas pump handle.

Referring to FIGS. 1–5, reference number 10 refers generally to the portable hands-free gas pumping device (herein "device 10") of the present invention. Referring now to FIG. 3, the components of a typical gas pump handle are shown. It comprises a gas pump handle frame 12 having a top portion 14 and a bottom portion 16, and an activation lever 18 for activating a flow of gas. The activation lever 18 has a bottom surface 20 and a top surface 22 and is positioned within the gas pump handle frame 12 between the top portion 14 and the bottom portion 16 of the gas pump handle frame 12. (The bottom portion of the gas pump handle frame 12 generally defines a U-shaped channel, while the bottom surface 20 is generally convex.) The activation lever 18 is activated by pulling it in a direction toward the top portion 14 of the gas pump handle frame 12.

Figure 1:
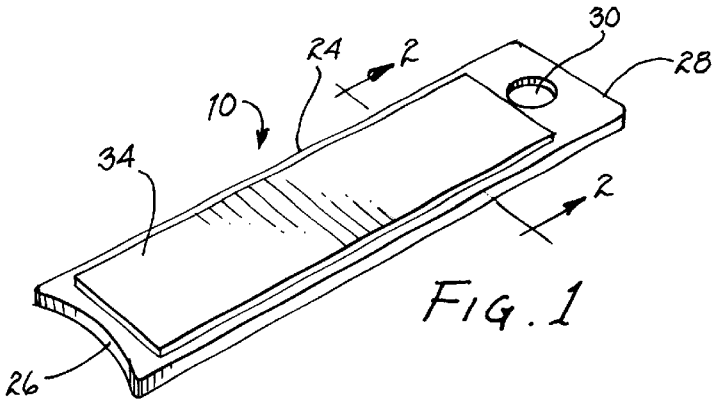
FIG. 1 is a perspective view of an embodiment of the portable hands-free gas pumping device of the present invention.
Figure 2:
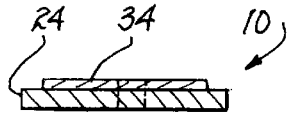
FIG. 2 is a cross-sectional view of the device of FIG. 1 taken along line 2—2.

Referring now to FIG. 1, the device 10 is shown. The device 10 comprises an elongated body 24 having a top portion 26 and a bottom portion 28. The elongated body 24 is dimensioned to be interposed between the bottom portion 16 of the gas pump handle frame 12 and the bottom surface 20 of the activation lever 18 when the activation lever 18 is in the activated position. The elongated body 24 maintains the activation lever 18 in an activated position.

In the preferred embodiment, the top portion 26 of the elongated body 24 is concave and dimensioned to mate with a corresponding convex bottom surface 20 of the activation lever 18. (It should be understood that substantial benefit could be derived from an alternative configuration in which the top portion 26 is not concave.)

Figure 5:
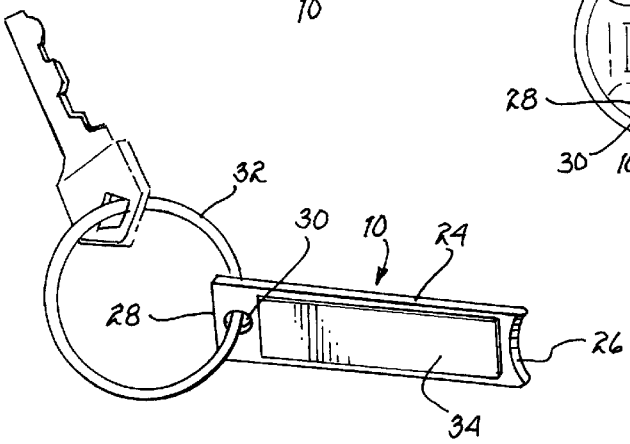
FIG. 5 is an perspective view of the device of FIG. 1 positioned on a key ring.

Referring now to FIG. 5, preferably, the elongated body 24 defines an aperture 30 proximate an end thereof for coupling the elongated body 24 to a key ring 32. The aperture 30 could be proximate the bottom portion 28, as shown in FIG. 5, or proximate the top portion 26. The aperture 30 permits ready transport of the device 10 and, assuming the key ring 32 also carries the user's car keys, virtually guarantees that the user will have the device 10 in his or her possession when going to a gas station. (It may be preferred in this regard to couple the device 10 to a key ring of the type that permits the ready attaching and de-attaching of individual keys without the necessity of removing the individual key from an actual ring, so as to permit especially convenient removal and reattachment by a user.)

Figure 4:
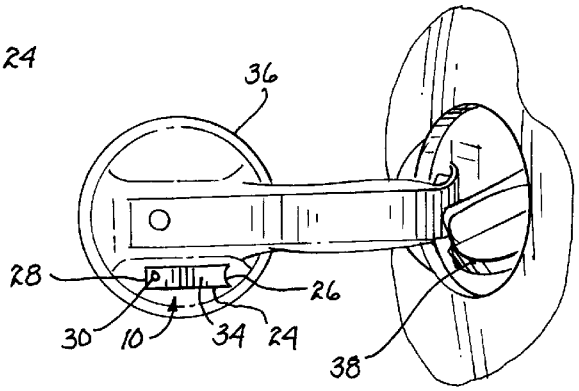
FIG. 4 is a front view of the device of FIG. 1 affixed to the inside of a gas tank protection lid.

Referring specifically to FIGS. 1 and 4, the device 10 further preferably comprises a magnet 34, which may be affixed (by gluing or other appropriate means) to one side of the elongated body 24 (as shown in FIGS. 1–3 and 5), or which may be integrated into the elongated body 24. Indeed, it would also be possible to magnetize the entire elongated body 24, so as to eliminate the need for affixing a magnet to the elongated body 24. The magnet 34—however configured—has sufficient attractive force to couple the device 10 in a fixed position to a metal object, and in particular to the inside of a gas tank protection lid 36. In this manner, the magnet 34 allows the device 10 to be easily stored in a manner that essentially guarantees that it will be able to be found and used when the user needs to pump gas. Alternatively, the device 10 could include a clipping mechanism or other retaining device (not shown) to affix the device 10 to a vehicle sun visor (not shown) or some other object if so desired—for example if there is no gas tank protection lid 36 or if the gas protection lid 36 is not made of metal.

In the preferred embodiment, the elongated body 24 is approximately 2.5 inches in length, approximately 0.68 inches in width, and approximately 0.125 inches in thickness, however it should be clearly understood that substantial benefit could also be provided from an alternative configuration of the elongated body 24 having dimensions which deviate, perhaps even substantially, from these dimensions—and in particular those relating to width and thickness. As regards the length of the elongated body 24, any length that maintains the activation lever 18 in at least a partial "on" position will impart some benefit, with the maximum benefit provided by a length capable of maintaining the activation lever in a fully "on" position.

While the invention has been particularly shown and described with reference to preferred embodiments thereof, it will be understood by those skilled in the art that the foregoing and other changes in form and details may be made therein without departing from the spirit and scope of the invention.

I claim:

1. A device for hands-free pumping of gas, comprising, in combination:

a portable, detached, flat, rectangular body having a top portion, a bottom portion, a first face and a second face;

wherein said portable, detached elongated body is dimensioned to be interposed between a bottom portion of a gas pump handle frame and a bottom surface of a gas activation lever when said activation lever is in an activated position, so as to maintain said activation lever in said activated position, and wherein said rectangular body has substantially the width of said activation lever; and wherein said top portion of said rectangular body comprises a single concave region dimensioned to mate with a corresponding convex bottom surface of said activation lever.

2. The device of claim 1 wherein said rectangular body defines an aperture for coupling said support member to a key ring.

3. The device of claim 2 wherein said rectangular body defines an aperture proximate said bottom portion of said rectangular body for coupling said support member to a key ring.

4. The device of claim 2 further comprising a rectangular magnet fixedly coupled to one of said first face and said second face of said rectangular body between said aperture and said single concave region, said magnet having sufficient attractive force to retain said elongated body in a fixed position when said magnet is brought into proximity with a metal object.

5. The device of claim 1 wherein said rectangular body is approximately 2.5 inches in length.

6. The device of claim 1 wherein said elongated body is approximately 0.68 inches in width.

7. The device of claim 1 wherein said elongated body is approximately 0.125 inches in thickness.

8. A method for hands-free pumping of gas, comprising, in combination:

providing a portable, detached, flat, rectangular body having a top portion, a bottom portion, a first face and a second face;

wherein said portable, detached elongated body is dimensioned to be interposed between a bottom portion of a gas pump handle frame and a bottom surface of a gas activation lever when said activation lever is in an activated position, so as to maintain said activation lever in said activated position, and wherein said rectangular body has substantially the width of said activation lever;

wherein said top portion of said rectangular body comprises a single concave region dimensioned to mate with a corresponding convex bottom surface of said activation lever;

activating said activation lever by pulling it in a direction toward said top portion of said gas pump handle frame; and interposing said rectangular body between said bottom portion of said gas pump handle frame and said bottom surface of said activation lever so as to maintain said activation lever in an activated position.

9. The method of claim 8 wherein said rectangular body defines an aperture for coupling said support member to a key ring.

10. The method of claim 9 wherein said rectangular body defines an aperture proximate said bottom portion of said rectangular body for coupling said support member to a key ring.

11. The method of claim 9 further comprising a rectangular magnet fixedly coupled to one of said first face and said second face of said rectangular body between said aperture and said single concave region, said magnet having sufficient attractive force to retain said rectangular body in a fixed position when said magnet is brought into proximity with a metal object.

12. The method of claim 8 wherein said rectangular body is approximately 2.5 inches in length.

13. The method of claim 8 wherein said rectangular body is approximately 0.68 inches in width.

14. The method of claim 8 wherein said rectangular body is approximately 0.125 inches in thickness.

* * * * *